United States Patent [19]

Hofmeister

[11] Patent Number: 5,002,272

[45] Date of Patent: Mar. 26, 1991

[54] RESILIENT SWIVEL EXERCISER

[75] Inventor: Brian E. Hofmeister, Sunnybank Hills, Australia

[73] Assignee: Hanover Holdings Pty. Ltd., Queensland, Australia

[21] Appl. No.: 289,623

[22] Filed: Dec. 23, 1988

[51] Int. Cl.[5] ..... A63B 21/02; A63B 21/04; A63B 23/10

[52] U.S. Cl. ..... 272/146; 272/96; 272/97; 272/135; 272/136; 272/140

[58] Field of Search ..... 272/146, 135, 136, 138, 272/140, 97, 96

[56] References Cited

U.S. PATENT DOCUMENTS

| | | | |
|---|---|---|---|
| 2,707,465 | 5/1955 | Nemeth | 272/146 X |
| 2,714,007 | 7/1955 | Jordan | 272/146 |
| 3,100,639 | 8/1963 | Bonewitz | 272/146 |
| 3,802,701 | 4/1974 | Good, Jr. | 272/140 X |
| 4,165,070 | 8/1979 | Rice | 272/140 X |
| 4,199,137 | 4/1980 | Giguère | 272/146 X |
| 4,739,986 | 4/1988 | Kucharik et al. | 272/96 |
| 4,822,039 | 4/1989 | Gonzales et al. | 272/146 |
| 4,836,538 | 6/1989 | Rice | 272/146 |

FOREIGN PATENT DOCUMENTS 507755 2/1975 Australia .

*Primary Examiner*—Richard J. Apley
*Assistant Examiner*—Lynne Reichard
*Attorney, Agent, or Firm*—Renner, Otto, Boisselle & Sklar

[57] ABSTRACT

An exercise apparatus including a base for resting on or for being secured to a support surface, a transversely extending support member, two rests located at spaced locations on the support member. The apparatus has the support member mounted to the base by resilient biasing means there-between normally retaining the support member in a rest position and enabling the support member to be oscillated about the rest position.

12 Claims, 2 Drawing Sheets

RESILIENT SWIVEL EXERCISER

BACKGROUND OF THE INVENTION

The invention relates to an exercise apparatus.

A variety of exercise machines and apparatus have been proposed or suggested. These machines range from complex and hence expensive machines typically found in gymnasiums or the like and are generally non-portable. At the other end of the spectrum are portable exercise machines or reduced cost and constructed and intended for home or office use. Such machines are either employed to exercise the arms or the legs.

One such machine comprised a stand or pedestal which carried a rotatable pedal crank assembly to which were mounted two opposed rotating pedals. A typical machine of this type is disclosed in Australian patent No. 507755. That machine could not, for example, be used in a confined space such as under a desk or the like. This was because the knees of the user would rise as a consequence of pedalling operation of that machine. In addition, the user would first need to locate the pedals which could be in any position along the circle described by the movement allowed by the crank assembly. Thus, the machine could not easily be used by a person with impaired vision or at a location where the machine was concealed, such as for example beneath a desk or the like.

SUMMARY OF THE INVENTION

It is an object of the present invention to provide an exercise apparatus which at least minimizes the disadvantages referred to above.

The invention provides an exercise apparatus having a base adapted to rest on or be secured to a support surface, a transversely extending support member, two rests located at spaced locations on the support member, said support member being mounted to said base and resilient biasing means between said support member and said base normally retaining the support member in a rest position and enabling said support member to be oscillated about said rest position.

The base preferably has a ground or support surface engaging surface. The ground engaging surface may be treated or otherwise adapted to frictionally resist movement over the ground. For example, the ground engaging surface may have a friction coating such as a rubber coating or may be contoured or serrated. The base has a raised portion. The raised portion may have any desired shape but preferably is generally cylindrical in shape. If desired, the ground engaging surface may comprise a skirt extending around the raised portion. To reduce the weight of the base, either or both of the skirt and raised portion may be apertured. These apertures not only serve to reduce the weight of the apparatus but one may function as a handle or grip enabling the apparatus to be grasped by the user.

The transversely extending support member includes an attachment portion for securing or mounting it to the base. The member preferably is elongate and has two opposed arms.

The arms may be cranked downwardly and forwardly and have free end portions which provide rests for the user's feet. The rests may be formed integrally with the arms or be provided as separate components either releasably or permanently secured to the arms.

The rests present a substantially flat surface upon which the user's feet may rest. Alternatively, the rests may act as hand grips where the apparatus is intended to be hand rather than foot operated. Where the rests are intended for feet, they may be treated, coated or adapted to render them slip resistant. In one embodiment the rests have a scored or serrated foot receiving surface. To further ensure that the user's feet do not slip off the rests, the rests may be provided with two spaced upright walls between which a user's foot may locate.

The resilient biasing means functions to maintain the support member in a rest position when not in use and ensures that it returns to that rest position after use has terminated. The biasing means may be a spring. Alternatively, the biasing means may consist of one or more hydraulic or pneumatic cylinder assemblies. In another embodiment, the biasing means may comprise a resilient material which couples or connects the support member to the base. In a particular preferred embodiment the biasing means comprises a body of resilient material and the support member has a portion thereof bonded thereto or embedded within it such that the member may be subjected to torsional forces and returns the support member to a rest position when those forces are released.

BRIEF DESCRIPTION OF THE DRAWINGS

The invention will be described by way of example with reference to the drawings in which.

DETAILED DESCRIPTION

Figure 1:
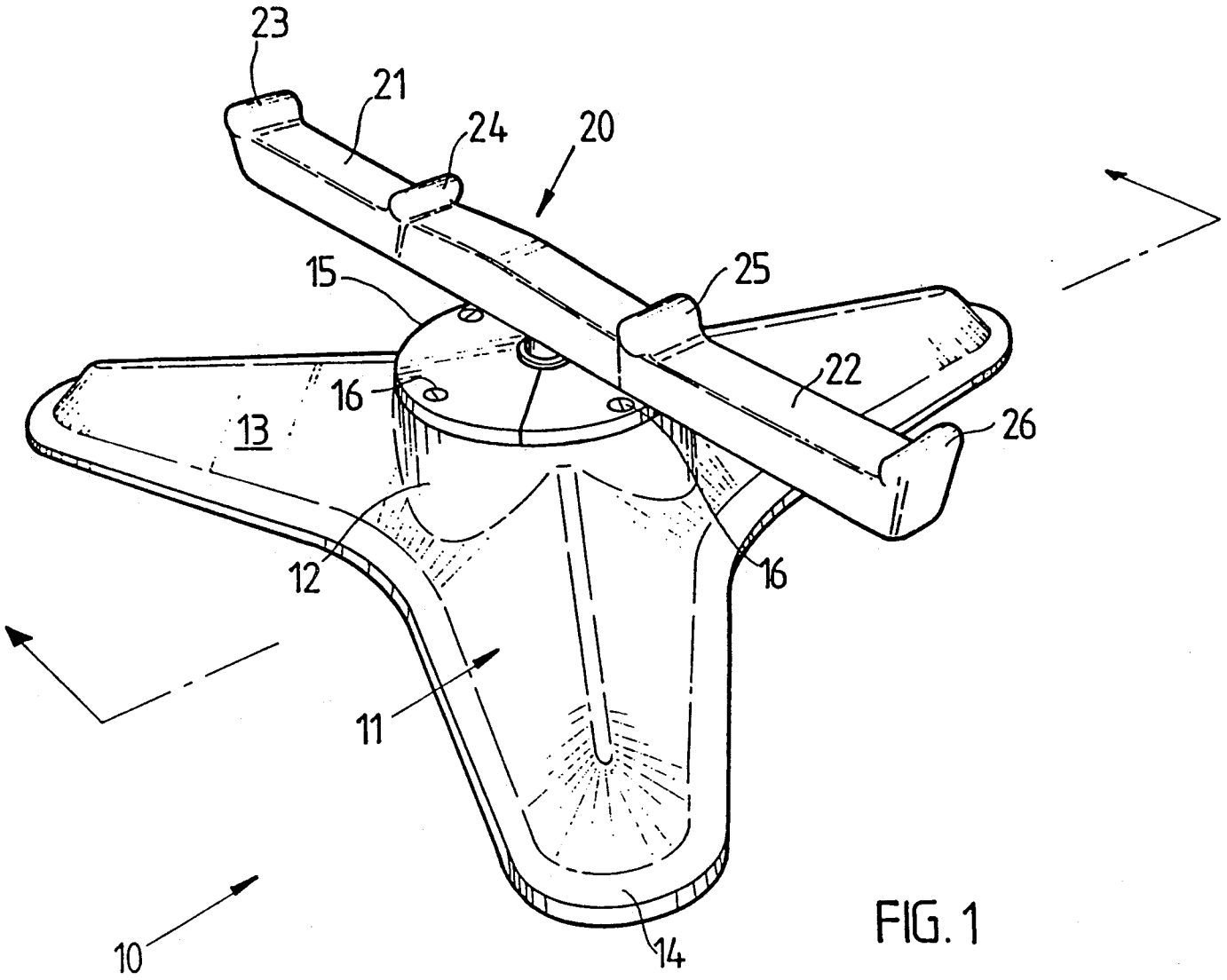
FIG. 1 is a perspective view of an exercise apparatus according to an embodiment of the invention and FIG. 2 is a section view along line II—II of FIG. 1.

The apparatus 10 has a base 11. The base has an upper part consisting of a cylindrical portion 12 and an inclined peripheral portion 13. A skirt 14 extends outwardly from and around the portion 13. A circular cap 15 extends over the cylindrical raised portion and is secured thereto by fasteners 16. Transversely extending support member 20 is mounted for pivotal reciprocal movement relative to the base 11.

Member 20 has rests 21, 22 upon which the feet of a user may rest. The rest 21 is defined by a tread portion located between upstanding stops 23, 24. Stops 23, 24 inhibit movement of the user's foot off the tread portion. Rest 22, likewise has upstanding stops 25, 26.

As is evident from FIG. 1, the apparatus 10 is substantially star shaped when viewed in plan view.

Figure 2:
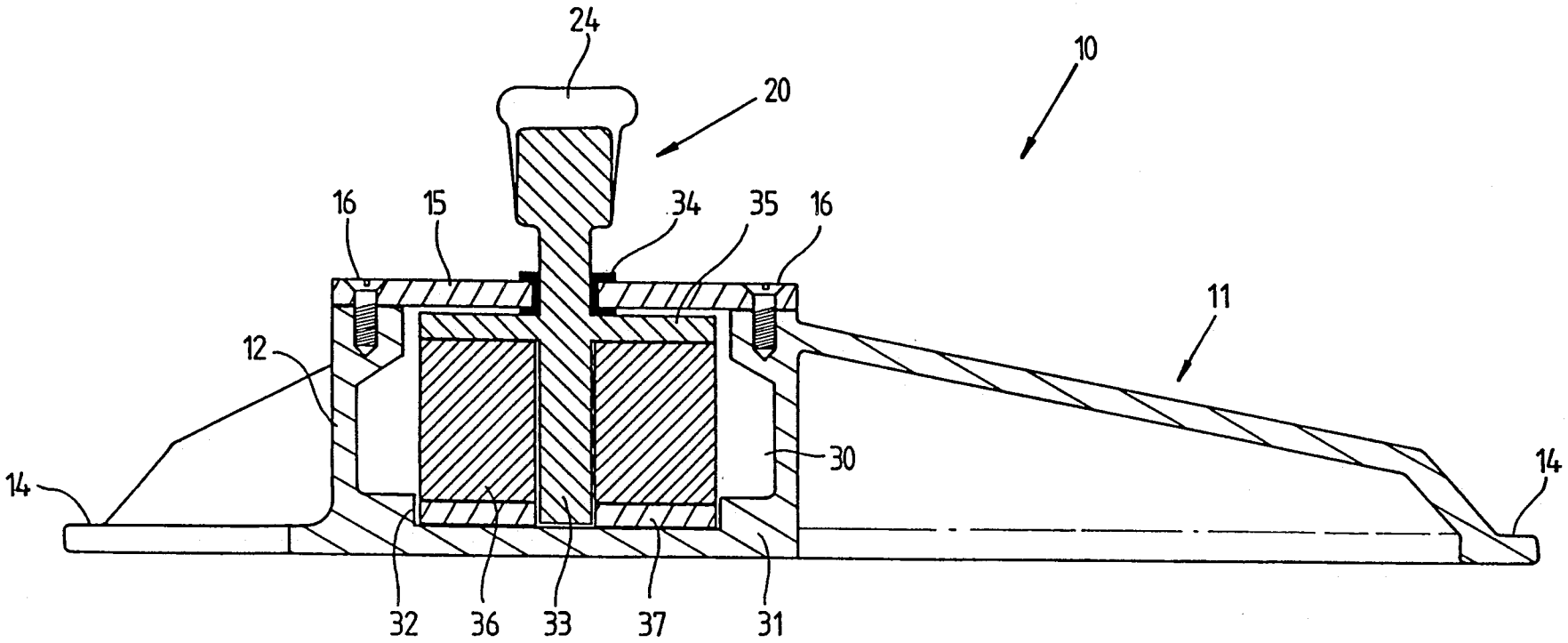

Greater detail of the apparatus 10 is shown in FIG. 2. Cylindrical portion 12 forms a chamber 30 having a bottom wall 31 formed with a square recess 32. The transverse member 20 has a downwardly extending arm 33 which extends through the cap 15.

A bush or bearing 34 is shown positioned between the arm 33 and the cap 15. When the member 20 is caused to pivot, it does so about an axis extending along arm 33. Extending outwardly from the arm 33 is a fixing member or disc 35. Disc 35 is bonded or otherwise secured to an upper surface of a block 36 of resilient material. The plate 37 is bonded or otherwise secured to the lower surface of the block and held against rotation by recess 32. This couples or connects the support member to the base.

In use, the apparatus 10 is placed on a support surface such as a floor. A user places his feet on rests 21, 22 and causes member 20 to oscillate about an axis extending along arm 33. When the user removes his feet from the apparatus, the resiliency of block 36 causes the member to return to its rest position as shown in FIG. 1.

The apparatus, rather than merely rest upon a surface, may be permanently fixed to a surface or a support. The apparatus need not be mounted or supported on a horizontal surface but may be mounted relative to an inclined surface or upright wall. Whilst the use of the apparatus has been described as suitable for exercising feet or legs it should be appreciated that this is by way of example only. The apparatus of the invention may be used by grasping rests 21, 22 with the hands and in this way the user's arms may be exercised.

What I claim is:

1. An exerciser apparatus comprising:

a stationary base adapted to rest on or be secured to a support surface;

a substantially horizontally extending beam member having a pair of spaced foot or hand supports adjacent opposite ends thereof; and means resiliently interconnecting said beam member to said base for rotational movement of said beam member, said means including:

a substantially vertical elongate shaft fixedly mounted centrally on said base or said beam member, bearing means on the other of said base or said beam member and rotatably engaging said shaft adjacent the upper end thereof, and a block of resiliently deformable material resiliently interconnecting said beam member and said base whereby said beam member may be oscillated in a horizontal plane from a rest position by out of balance pressures exerted on said foot or hand supports against resistance provided by said resiliently deformable member.

2. The apparatus of claim 1 wherein the block is secured at one location to the beam member and at another spaced location is held relative to the base.

3. The apparatus of claim 2 wherein the beam member has a depending arm with a fixing member extending therefrom, said fixing member being bonded or secured to one face of the block, a mounting bonded or secured to said block and spaced from said one face, said mounting being held or restrained relative to the base.

4. The apparatus of claim 3 wherein said oscillation may occur about an axis extending along the arm.

5. The apparatus of claim 3 wherein said mounting is a square or rectangular plate and said base has a recess for receiving the plate and which said recess restrains said plate against rotation when said beam member oscillates.

6. The apparatus of claim 5 including a skirt extending around and outwardly from the base.

7. The apparatus of claim 1 wherein the foot or hand supports include means for making the supports slip resistant.

8. The apparatus of claim 7 wherein each said foot or hand support has spaced apart upstanding stops which between them, define a location for a user's foot.

9. An exerciser apparatus as claimed in claim 1 wherein said shaft is fixedly mounted on said beam member.

10. An exerciser apparatus as claimed in claim 9 wherein said bearing means operates to limit rotation of said shaft to rotation about its axis.

11. An exerciser apparatus as claimed in claim 1 wherein said bearing means coacts with said shaft to limit rotation of said beam member to rotation about an axis parallel to said shaft.

12. The apparatus of claim 1 including a skirt extending around and outwardly from the base.

* * * * *